US005743372A

United States Patent [19]

Furuya

[11] Patent Number: 5,743,372

[45] Date of Patent: Apr. 28, 1998

[54] COIN DISCRIMINATING APPARATUS

[75] Inventor: Katusuke Furuya, Matsudo, Japan

[73] Assignee: Laurel Bank Machines Co., Ltd., Tokyo, Japan

[21] Appl. No.: 678,537

[22] Filed: Jul. 5, 1996

[30] Foreign Application Priority Data

Jul. 17, 1995 [JP] Japan ..... 7-179875

[51] Int. Cl.[6] ..... G07D 5/08

[52] U.S. Cl. ..... 194/318

[58] Field of Search ..... 194/317, 318, 194/206

[56] References Cited

U.S. PATENT DOCUMENTS 4,536,709 8/1985 Ishida ..... 194/206 X 5,076,414 12/1991 Kimoto ..... 194/317

FOREIGN PATENT DOCUMENTS 61-150093 7/1986 Japan .

*Primary Examiner*—F. J. Bartuska

*Attorney, Agent, or Firm*—Cushman Darby & Cushman IP Group of Pillsbury Madison & Sutro LLP

[57] ABSTRACT

A coin discriminating apparatus for discriminating coins transported in a coin passage includes a magnetic sensor having oscillating inductors and receiving inductors, the receiving inductors being constituted by connecting a plurality of tip-like inductors disposed in a direction perpendicular to a longitudinal direction of the coin passage in series with each other, the respective tip-like inducers having capacities selected so that output levels thereof are equal with respect to magnetic flux density produced by supplying electrical current of high frequency into the oscillating inductors. According to the thus constituted coin discriminating apparatus, it is possible to discriminate coin acceptability and coin denomination at low cost and with high accuracy.

12 Claims, 5 Drawing Sheets

COIN DISCRIMINATING APPARATUS

BACKGROUND OF THE INVENTION

The present invention relates to a coin discriminating apparatus and, in particular, to a coin discriminating apparatus having a magnetic sensor which can discriminate coin acceptability and coin denomination of a coin at low cost and high accuracy.

DESCRIPTION OF THE PRIOR ART

In a coin handling machine such as a coin wrapping machine, a coin passage through which coins are transported is provided with a coin discriminating apparatus for discriminating unacceptable coins such as counterfeit coins and foreign coins and the denomination of coins. This coin discriminating apparatus is ordinarily provided in the coin passage through which coins are transported and comprises an optical sensor for optically detecting the diameter of each coin and a magnetic sensor for detecting magnetic properties of the coin and is adapted to discriminate whether or not the coin is acceptable and the denomination of the coin based on the diameter detected by the optical sensor and the magnetic properties detected by the magnetic sensor.

The magnetic sensor of this kind of a coin discriminating apparatus comprises an oscillation coil and a receiving coil which are disposed above and below the coin passage and is adapted to detect the properties of a coin in accordance with an output level of the receiving coil when a coin transported in the coin passage while being pressed onto the surface of the coin passage by a transporting belt passes through a space between the oscillation coil and the receiving coil. Therefore, since the output level of the receiving coil depends on the positions where coins pass through the magnetic sensor in the widthwise direction of the coin passage even if the denomination of coins is identical, the coin handling machine is constituted so as to transport coins along a reference guide rail among a pair of guide rails defining the coin passage and discrimination is made as to coin acceptability and coin denomination by comparing reference data obtained as magnetic data when each denomination of coins is transported along the reference guide rail and stored in a memory with magnetic data of the detected coin.

However, since it is impossible to always transport coins along the reference guide rail in the coin passage, coin discriminating apparatuses which can discriminate coins with high accuracy using a magnetic sensor even if not all coins are transported along the reference guide rail have been proposed.

Japanese Patent Application Laid Open No. 61-150093 proposes a magnetic sensor comprising a primary core around which a primary coil and a secondary coil are wound and two secondary cores around which secondary coils are wound and capable of detecting the magnetic properties of a coin with high accuracy irrespective of the position where the coin passes through in the widthwise direction of the coin passage by determining the cross section of the secondary core so that a distance between the secondary core and the upper surface of the primary core gradually increases toward side portions of the coin passage from the center portion thereof, thereby linearly changing the differential output between the secondary coil of the primary core and the respective secondary coils of the secondary coils.

Further, Japanese Patent Application Laid Open No. 3-73091 proposes a coin discriminating apparatus which has a magnetic sensor and can detect the magnetic properties of a coin irrespective of the position of the coin in the lateral direction as it passes through a coin passage by detecting the position in the lateral direction of a coin passing through the coin passage with a line sensor and selecting reference data to be compared from among reference data in accordance with the position of the coin, or correcting reference data or magnetic data.

However, the magnetic sensor disclosed in Japanese Patent Application Laid Open No. 61-150093 has a problem of being expensive, since the shape of the secondary coils wound around the secondary core is complicated and coils having a specific shape are necessary. In a coin discriminating apparatus disclosed in Japanese Patent Application Laid Open No. 3-73091, on the other hand, although commercially available coils can be used, the apparatus requires a memory having a large reference storage capacity or means for correcting reference data or detected magnetic data in accordance with the positions where the coins pass through the coin passage. It, therefore, has problems of high cost, long calculation time and the like.

SUMMARY OF THE INVENTION

It is therefore an object of the present invention to provide a coin discriminating apparatus having a magnetic sensor which can discriminate coin acceptability and coin denomination at low cost and with high accuracy.

The above and other objects of the present invention can be accomplished by a coin discriminating apparatus for discriminating coins transported in a coin passage comprising a magnetic sensor having oscillating inductor means and receiving inductor means, the receiving inductor means being constituted by connecting a plurality of tip-like inductors disposed in a direction perpendicular to a longitudinal direction of the coin passage in series with each other, the respective tip-like inducers having capacities selected so that output levels thereof are equal with respect to magnetic flux density produced by supplying electrical current of high frequency into the oscillating inductor means.

In a preferred aspect of the present invention, the plurality of tip-like inductors constituting the receiving inductor means are arranged in a zigzag pattern and adjacent tip-like inductors are in contact with each other.

In a further preferred aspect of the present invention, the oscillating inductor means comprises a plurality of tip-like inductors.

In a further preferred aspect of the present invention, the tip-like inductor comprises a core and a coil wound around the core, the ends thereof being fixed to the core with conductive coating materials.

In a further preferred aspect of the present invention, the receiving inductor means is constituted by connecting the conductive coating materials of adjacent tip-like inductors with wires.

In a further preferred aspect of the present invention, an optical sensor is further provided.

In the present invention, "TIP COIL LQH (N) 4N" manufactured by MURATA MFG. CO., LTD. can be preferably used as a tip-like inductor.

The above and other objects and features of the present invention will become apparent from the following description made with reference to the accompanying drawings.

DESCRIPTION OF THE PREFERRED EMBODIMENTS

Figure 1:
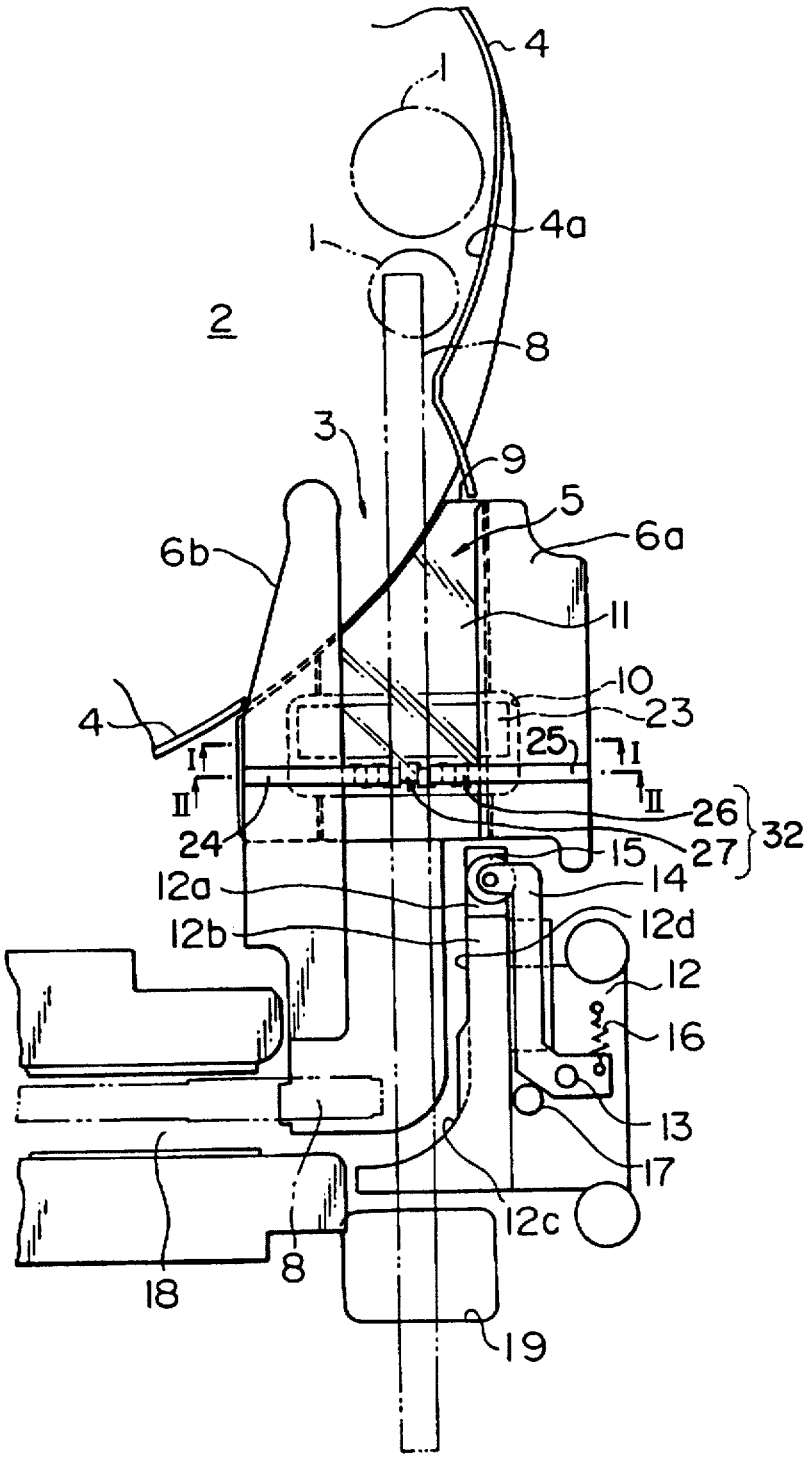
FIG. 1 is a schematic plan view of a coin passage portion of a coin handling machine including a coin discriminating apparatus which is an embodiment of the present invention.

As shown in FIG. 1, coins 1 deposited through a coin depositing portion (not shown) into a coin handling machine are fed onto a rotatable disk 2 by a transporting mechanism (not shown). Coins 1 fed onto the rotatable disk 2 include coins of various denominations and, in some cases, uncurrent coins such as counterfeit coins and foreign coins. The periphery of the rotatable disk 2 is formed with an annular guide 4 formed with an opening 3 and coins 1 are lead along the inner surface of the annular guide 4 and fed into a coin passage 5 connected to the opening 3.

A pair of guide members 6*a* and 6*b* are provided at opposite sides of the coin passage 5 and the space between the pair of guide members 6*a* and 6*b* is set so that coins 1 of the greatest diameter to be handled can pass therebetween. Above the coin passage 5, a transporting belt 8 wound around pulleys 7, 7 is provided so as to be able to transport coins 1 by holding them between itself and the upper surface of the coin passage 5. The rotatable disk 2 and the pulleys 7, 7 can be rotated in both the forward and reverse directions by a drive means (not shown). The annular guide 4 includes a projecting portion 4*a* which is projected immediately upstream of the opening 3 with respect to the rotating direction of the rotatable disk 2 when the rotatable disk 2 is rotated so as to feed coins 1 into the coin passage 5. Therefore, coins 1 fed from the rotatable disk 2 into the coin passage 5 are fed toward the guide member 6*b* of the coin passage 5 by the projecting portion 4*a*, ensuring that coins 1 are transported by the transporting belt 8 along the guide member 6*b* in the coin passage 5.

The coin passage 5 comprises a bottom plate 9 formed with a light receiving opening 10 and a glass plate 11 is fitted into the bottom plate 9 for covering the light receiving opening 10 so that the upper surface of the glass plate 11 is positioned in the same plane as the upper surface of the rotatable disk 2.

A guide block 12 is provided downstream of the coin passage 5. The guide block can be adjusted in position in the direction perpendicular to the transporting direction of coins 1 and is set so that the space between itself and the guide member 6*b* is greater than the diameter of coins 1 to be wrapped and is smaller than the diameter of the smallest coins 1 among coins whose diameter is greater than that of coins 1 to be wrapped. The guide block 12 includes an inclined portion 12*a* which becomes gradually higher in the transporting direction of coins 1, a horizontal portion 12*b* connected to the downstream end of the inclined portion 12*a* and a side surface 12*d* having a bent portion 12*c* downstream of the inclined portion 12*a*. One end portion of an arm 14 swingable about a shaft 13 is mounted on the guide block 12 and a rotatable roller 15 is mounted at the other end portion of the arm 14. One end of a tension spring 16 whose other end is fastened to the guide block 12 is fastened to the arm 14 to bias the arm 14 counterclockwise in FIG. 1. The position of the arm 14 is regulated by a stopper pin 17 so that the roller 15 is located on the inclined portion 12*a* and the outer surface of the roller 15 is positioned in the same plane as the side surface of the inclined surface 12*a* on the coin passage 5.

The direction of the coin passage 5 is bent by about 90 degrees along the bent portion 12*c* of the guide block 12 and the coin passage 5 downstream of the bent portion 12*c* is formed with a smaller coin collecting opening 18 for collecting coins 1 whose diameter is smaller than that of coins 1 to be wrapped. The diameter of the smaller coin collecting opening is adjustable. A larger coin collecting opening 19 is provided downstream of the guide block 12 in the direction in which the coin passage 5 extends from the rotatable disk 2 for collecting coins 1 whose diameter is greater than coins 1 to be wrapped and the diameter thereof is large enough to collect the greatest diameter of coins deposited into the coin handling machine. Therefore, once the diameter of the smaller coin collecting opening 18 has been set to be smaller than the diameter of coins 1 to be wrapped and greater than that of the greatest coins among coins 1 whose diameter is smaller than that of coins 1 to be wrapped and the space between the guide member 6*b* and the side surface 12*d* of the guide block 12 has been set to be greater than the diameter of coins 1 to be wrapped and smaller than that of the smallest coins 1 among coins 1 whose diameter is greater than that of coins 1 to be wrapped, then when coins 1 are fed from the rotatable disk 2 into the coin passage 5, coins 1 to be wrapped and smaller coins 1 than those to be wrapped (hereinafter referred to as "smaller coins") among coins 1 which have been transported in the coin passage 5 from the rotatable disk 2 are guided by the side surface 12*d* and the bent portion 12*c* of the guide block 12 and after the transporting direction thereof has changed by about 90 degrees at the bent portion 12*c*, they are fed downstream of the coin passage 5, whereby the smaller coins 1 fall into the smaller coin collecting opening 18 and are collected, while coins to be wrapped are further fed downstream in the coin passage 5 and after a predetermined number of the coins have been stacked by a stacking device (not shown), the coins are wrapped each predetermined number by a wrapping device (not shown). Since the space between the guide member 6*b* and the side surface 12*d* of the guide block 12 is set to be greater than the diameter of coins 1 to be wrapped and smaller than that of the smallest coins 1 among coins 1 whose diameter is greater than that of coins 1 to be wrapped, on the contrary, one edge portion of each coin 1 whose diameter is greater than that of coins 1 to be wrapped (hereinafter referred to as "a larger coin") is led by the inner surface of the guide member 6*b* and other edge portion thereof climbs the inclined portion 12*a* of the guide block 12 and is fed on the horizontal portion 12*b* as inclined. As a result, the larger coins are not guided by the bent portion 12*c* and fall into the larger coin collecting opening 19 to be collected.

Figure 2:
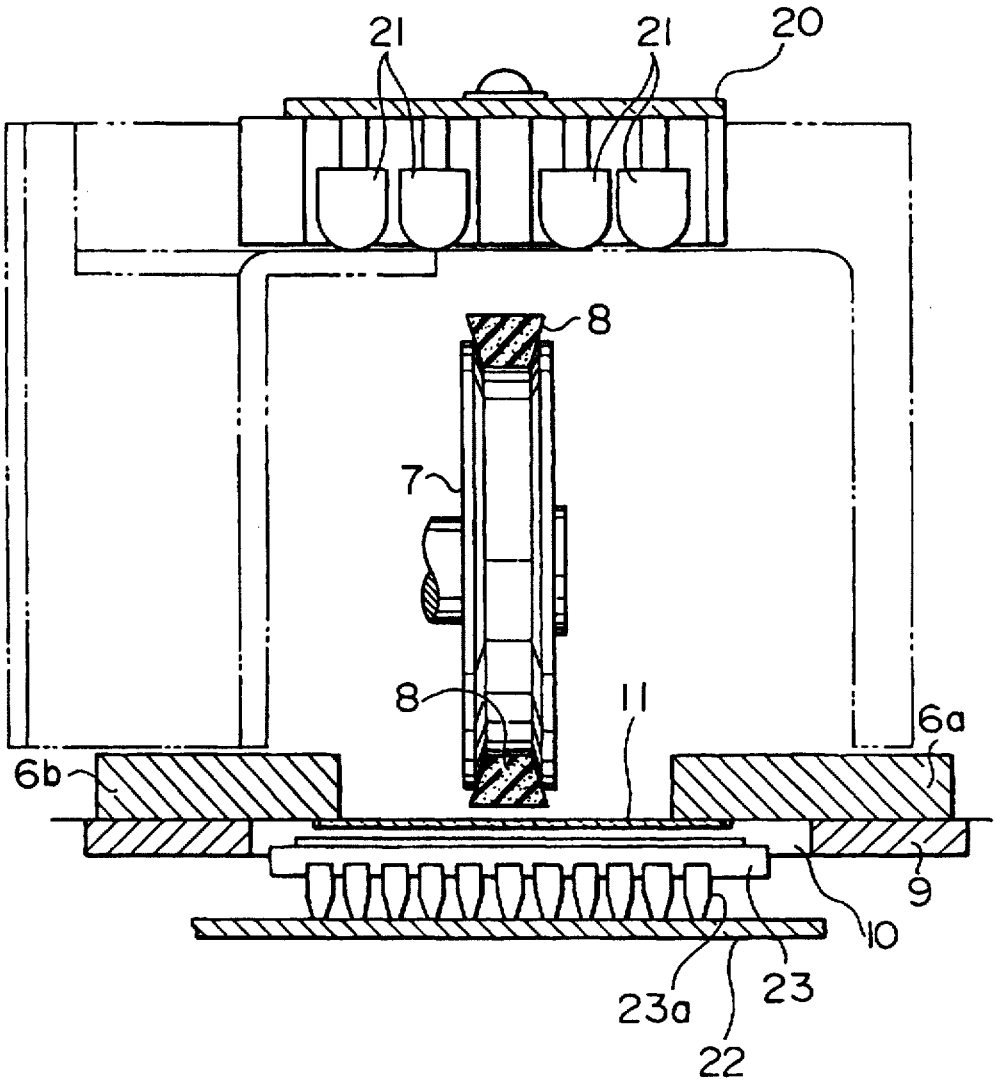
FIG. 2 is a schematic cross sectional view taken along a line I—I in FIG. 1.

As shown in FIG. 2, a plurality of light emitting elements 21 are mounted on a stay 20 provided above the coin passage 5 upstream of the guide block 12 in a direction perpendicular to the transporting direction of coins 1. A line sensor 23 comprising a plurality of light receiving elements is mounted via terminals 23*a* on a board 22 below the glass plate 11 fitted into the bottom plate 9 along a direction perpendicular to the transporting direction of coins 1 at a position opposite to the plurality of light emitting elements 21 where light emitted from the light emitting elements 21 toward the coin passage 5 can be received.

Figure 3:
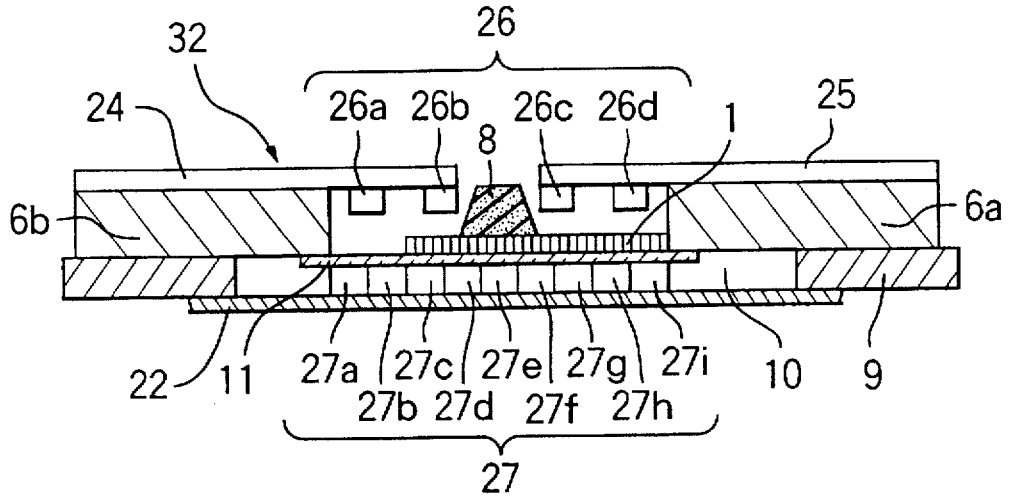
FIG. 3 is a schematic cross sectional view taken along a line II—II in FIG. 1.

As shown in FIG. 3, stays 24 and 25 are respectively mounted on the guide members 6*a* and 6*b* and an oscillating inductor group 26 comprising a plurality of tip-like oscillating inductors 26*a*, 26*b*, 26*c* and 26*d*is mounted on the stays 24 and 25 along a direction perpendicular to the transporting direction of coins 1. A receiving inductor group 27 comprising a plurality of tip-like receiving inductors 27*a* to 27*i* is mounted on the upper surface of the board 22 at a position opposite to the tip-like oscillating inductors 26*a*, 26*b*, 26*c* and 26*d* along a direction perpendicular to the transporting direction of coins 1 so as to be in contact with each other.

Figure 4:
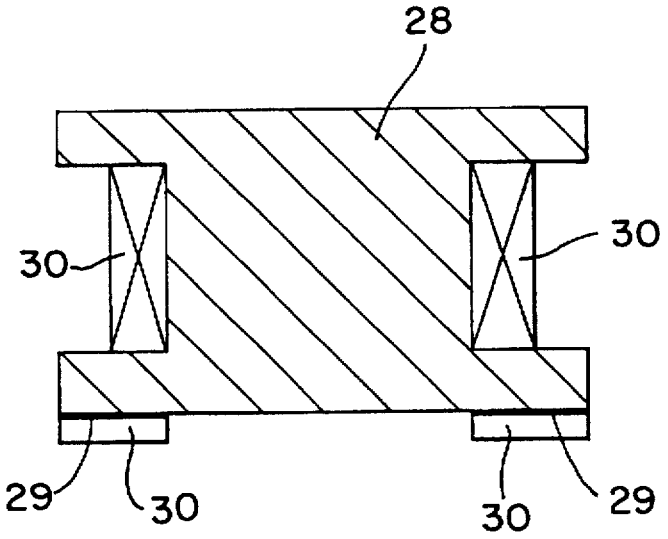
FIG. 4 is a schematic longitudinal cross sectional view showing tip-like inductors.

FIG. 4 is a schematic longitudinal cross sectional view showing the structure of the tip-like inductors 26*a* to 26*d* and 27*a* to 27*i*. The tip-like inductors 26*a* to 26*d* and 27*a* to 27*i* are commercially available and, as shown in FIG. 4, each comprises a core 28 and a coil 30 whose ends are fixed to the core 28 with a conductive coating material 29. In the present, "TIP COIL LQH (N) 4N" manufactured by MURATA MFG. CO., LTD. can be preferably used as the tip-like inductor.

Figure 5:
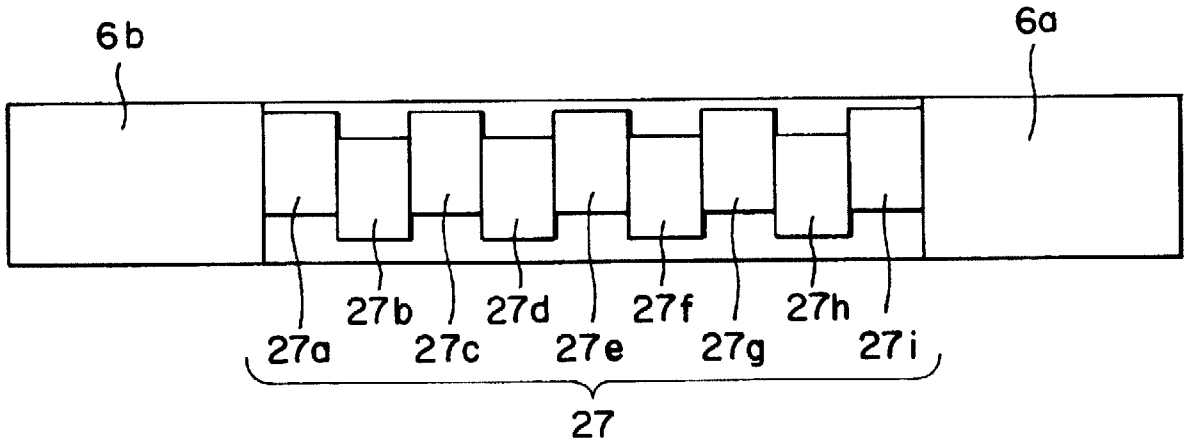
FIG. 5 is a schematic plan view showing the arrangement of a plurality of tip-like receiving inductors.
Figure 6:
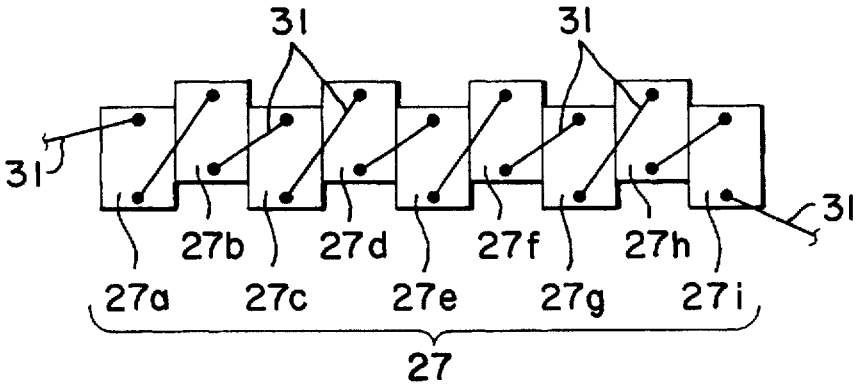
FIG. 6 is a schematic rear view of FIG. 5.

FIG. 5 is a schematic plan view showing the arrangement of a plurality of tip-like receiving inductors 27*a* to 27*i* and FIG. 6 is a schematic rear view thereof. The plurality of tip-like receiving inductors 27*a* to 27*i* are arranged in a zigzag pattern and the conductive coating materials 29 of the respective inductors are connected to each other in series by conductor wires 31. The reason why the plurality of tip-like receiving inductors 27*a* to 27*i* are arranged in a zigzag pattern is to prevent the conductive coating materials of adjacent inductors from coming into contact with each other and causing a short-circuit.

Electrical current of high frequency is supplied to the coils 30 of the plurality of tip-like oscillating inductors 26*a*, 26*b*, 26*c* and 26*d*to form a magnetic field below the coils 30, whereby a magnetic sensor 32 is formed by the oscillating inductor group 26 comprising the plurality of tip-like oscillating inductors 26*a*, 26*b*, 26*c* and 26*d* and the receiving inductor group 27 comprising the plurality of tip-like receiving inductors 27*a* to 27*i*.

As can be understood from FIGS. 1,2 and 3, the oscillating inductor group 26 comprising the plurality of tip-like oscillating inductors 26*a*, 26*b*, 26*c* and 26*d* and the receiving inductor group 27 comprising the plurality of tip-like receiving inductors 27*a* to 27*i* are disposed downstream of the line sensor 23 and adjacent thereto. As a result, when a coin 1 fed from the rotatable disk 2 into the coin passage 5 and transported in the coin passage 5 by the transporting belt 8 passes above the line sensor 23, a part of the light emitted from the light emitting elements 21 is intercepted and some pixels of the line sensor 23 do not receive light emitted from the light emitting elements 21. Therefore, it is possible to detect the diameter of the coin 1 based on the number of pixels which do not receive light, namely, optical data detected by the line sensor 23. Further, when a coin 1 passes between the oscillating inductor group 26 and the receiving inductor group 27, the magnetic field produced by the plurality of tip-like inductors 26*a*, 26*b*, 26*c* and 26*d* is changed and electrical current flowing in the coils 30 of the plurality of tip-like receiving inductors 27*a* to 27*i* is changed according to the change in the magnetic field. Since the value of change in electrical current depends on the materials of coins 1, it is possible to discriminate the material of the coin 1 based on the value of change in electrical current flowing in the coils 30 of the plurality of tip-like receiving inductors 27*a* to 27*i*.

In this embodiment, the tip-like receiving inductors 27*a* to 27*i* are not connected to each other but arranged as shown in FIG. 5. Electrical current of high frequency is supplied to the plurality of tip-like oscillating inductors 26*a*, 26*b*, 26*c* and 26*d*, the output level of each of tip-like receiving inductors 27*a* to 27*i* is detected and the capacity of each tip-like receiving inductor 27*a* to 27*i* is selected so that the output levels of tip-like receiving inductors 27*a* to 27*i* become equal. After the capacity of each tip-like receiving inductor 27*a* to 27*i* has been selected in this manner, the conductive coating materials 29 of the tip-like receiving inductors 27*a* to 27*i* are connected to each other to form a magnetic sensor 32. As a result, tip-like receiving inductors 27*a* to 27*i* having small capacity are disposed at portions where magnetic flux density on the receiving side is low, while tip-like receiving inductors 27*a* to 27*i* having great capacity are disposed at portions where magnetic flux density on the receiving side is high. In other words, the magnetic sensor 32 is formed by selecting the capacity of the respective tip-like receiving inductors 27*a* to 27*i* so that the amount of change in the output levels of the tip-like receiving inductors 27*a* to 27*i* is proportional to the total area of the receiving inductors 27*a* to 27*i* covered by a coin 1 passing through the magnetic sensor 32. Then, even when coins 1 pass through the magnetic sensor at various positions in the lateral direction of the coin passage 5, the amount of change in the output levels of the tip-like receiving inductors 27*a* to 27*i* is equal for coins 1 of the same denomination. As a result, it is possible to discriminate coins with high accuracy by detecting their magnetic properties.

According to this embodiment, tip-like inductors readily available on the market are used and tip-like receiving inductors 27*a* to 27*i* having small capacity are disposed at portions where magnetic flux density on the receiving side is low, while tip-like receiving inductors 27*a* to 27*i* having great capacity are disposed at portions where magnetic flux density on the receiving side is high and the magnetic sensor 32 is formed by selecting the capacity of each of tip-like receiving inductors 27*a* to 27*i* so that the amount of change in the output levels of the tip-like receiving inductors 27*a* to 27*i* is proportional to a total area of the receiving inductors 27*a* to 27*i* covered by a coin 1 passing through the magnetic sensor 32. Therefore, merely by constituting the magnetic sensor in the above described manner, it is possible to make the amount of change in the output levels of the tip-like receiving inductors 27*a* to 27*i* equal for the coins of the same denomination even when the coins 1 pass through the magnetic sensor at various positions in the lateral direction of the coin passage 5. It is therefore possible to discriminate coin acceptability and coin denomination at low cost and with high accuracy.

The present invention has thus been shown and described with reference to specific embodiments. However, it should be noted that the present invention is in no way limited to the details of the described arrangements but changes and modifications may be made without departing from the scope of the appended claims.

For example, in the above described embodiment, although the tip-like oscillating inductors 26*a*, 26*b*, 26*c* and 26*d* are used as an oscillating inductor, a plurality of primary coils may be used instead of the tip-like oscillating inductors 26*a*, 26*b*, 26*c* and 26*d*.

Further, in the above described embodiment, although the magnetic sensor 32 is constituted using four tip-like oscillating inductors 26*a*, 26*b*, 26*c* and 26*d* and nine receiving inductors 27*a* to 27*i*, the number of tip-like inductors used as oscillating inductors and the number of tip-like inductors used as receiving inductors are not limited to those in the above described embodiment and may be arbitrarily selected.

Moreover, in the above described embodiment, although the magnetic sensor 32 is disposed downstream of the line sensor 23, the positional relationship between the line sensor 23 and the magnetic sensor 32 may arbitrarily selected.

According to the present invention, it is possible to provide a coin discriminating apparatus having a magnetic sensor which can discriminate coin acceptability and coin denomination at low cost and with high accuracy.

I claim:

1. A coin discriminating apparatus for discriminating coins transported in a coin passage comprising:

a magnetic sensor having oscillating inductor means and receiving inductor means, the receiving inductor means being constituted by connecting a plurality of tip-like inductors disposed in a direction perpendicular to a longitudinal direction of the coin passage in series with each other, the respective tip-like inductors having capacities selected so that output levels thereof are equal with respect to magnetic flux density produced by supplying electrical current of high frequency into the oscillating inductor means, wherein the plurality of tip-like inductors constituting the receiving inductor means are arranged in a zigzag pattern and adjacent tip-like inductors are in contact with each other.

2. A coin discriminating apparatus in accordance with claim 1 wherein the oscillating inductor means comprises another plurality of tip-like inductors.

3. A coin discriminating apparatus in accordance with claim 1 wherein the tip-like inductor each comprises a core and a coil wound around the core, the ends thereof being fixed to the core with conductive coating materials.

4. A coin discriminating apparatus in accordance with claim 2 wherein the tip-like inductors each comprises a core and a coil wound around the core, the ends thereof being fixed to the core with conductive coating materials.

5. A coin discriminating apparatus in accordance with claim 3 wherein the receiving inductor means is constituted by connecting the conductive coating materials of adjacent tip-like inductors with wires.

6. A coin discriminating apparatus in accordance with claim 3 wherein the receiving inductor means is constituted by connecting the conductive coating materials of adjacent tip-like inductors with wires.

7. A coin discriminating apparatus in accordance with claim 4 wherein the receiving inductor means is constituted by connecting the conductive coating materials of adjacent tip-like inductors with wires.

8. A coin discriminating apparatus in accordance with claim 4 wherein the receiving inductor means is constituted by connecting the conductive coating materials of adjacent tip-like inductors with wires.

9. A coin discriminating apparatus in accordance with claim 1 which further comprises an optical sensor for detecting coin diameter.

10. A coin discriminating apparatus in accordance with claim 2 which further comprises an optical sensor for detecting coin diameter.

11. A coin discriminating apparatus in accordance with claim 3 which further comprises an optical sensor for detecting coin diameter.

12. A coin discriminating apparatus in accordance with claim 4 which further comprises an optical sensor for detecting coin diameter.

* * * * *